US005621420A

United States Patent [19]

Benson

[11] Patent Number: 5,621,420

[45] Date of Patent: Apr. 15, 1997

[54] DUPLEX MONOPOLE ANTENNA

[75] Inventor: John F. Benson, Glendora, Calif.

[73] Assignee: Comant Industries, Inc., Santa Fe Springs, Calif.

[21] Appl. No.: 418,533

[22] Filed: Apr. 7, 1995

[51] Int. Cl.[6] ..... H01Q 9/04

[52] U.S. Cl. ..... 343/791; 343/790; 343/872

[58] Field of Search ..... 343/790, 791, 343/792, 725, 727, 729, 730, 749, 872, 830

[56] References Cited

U.S. PATENT DOCUMENTS

| | | | |
|---|---|---|---|
| 4,725,846 | 2/1988 | Hendershot | 343/791 |
| 5,105,199 | 4/1992 | Ukmar | 343/791 |
| 5,231,412 | 7/1993 | Eberhardt et al. | 343/790 |
| 5,311,201 | 5/1994 | Lillie et al. | 343/791 |
| 5,317,327 | 5/1994 | Piole | 343/790 |

*Primary Examiner*—Donald T. Hajec
*Assistant Examiner*—Tan Ho
*Attorney, Agent, or Firm*—Edward Dreyfus

[57] ABSTRACT

A monopole antenna for aircraft, vehicles, marine vessels and the like comprises a coaxial cable radiator and a metal tube radiator surrounding the lower half of the coaxial cable. The center conductor of a coaxial cable connector applies radiant energy to the jacket of the coaxial radiator. The center conductor of the coaxial radiator extends from the bottom of the cable and is connected to the outer lower surface of the metal tube radiator. In operation, the distributed L-C and R-C values at resonance couple radiation energy to the metal tube radiator while the tube suppresses radiation from the jacket except for radiation from the upper portion thereof. Tests comparing the radiation pattern of the above antenna without ground plane and a conventional monopole antenna with ground plane indicate that the radiation pattern is extended in the forward, axial (zero degree) direction although some loss occurs in the + and −90 degree direction. This range extension is beneficial for directed communications and other applications. Other advantages resulting from the present invention are also disclosed including being functional when installed in a non-conventional manner.

15 Claims, 4 Drawing Sheets

MAGNITUDE dB VS. ELEVATION

DUPLEX MONOPOLE ANTENNA

BACKGROUND

The present invention relates to monopole antennas and, more particularly to a new and improved monopole antenna that radiates an improved radiation pattern and does not require a ground plane.

Recent advances in materials and structural designs have enabled manufacturers of small aircraft to make a greater number of aircraft designs with the use of non-metallic composite materials or fabrics.

In general, antenna for such aircraft can be of a dipole type or monopole type with a ground plane cooperating therewith. An advantage of the monopole type results from the antenna having smaller dimensions. However, in most monopole antennas the ground plane comprises a horizontal metal plate through which coax connections are made and upon which the vertically oriented antenna is mounted. This ground plate does not cause significant technical metallic aircraft problems but raises problems for non-metallic aircraft because of the difficulty in fabricating the ground plate as part of the aircraft.

For these reasons, the dipole antenna is used in many non-metallic aircraft applications. One conventional dipole antenna for such application comprises simply a balun transformer coupled to two strips of one or one and one-half inch wide copper tape extending in opposite directions or forming a V-shaped configuration and supported on a vertical part of the aircraft. The design parameters of these conventional dipole antennas, however, can not be closely configured and are generally unreliable in operation.

Recent improved designs of antenna for non-metallic aircraft include dipole and loop antennas disclosed in copending U.S. patent application Ser. No. 08/371,510 filed Jan. 11, 1995 which discloses such antennas formed of metal clad secured to a dielectric substrate. Said co-pending patent application is owned by the assignee of the present patent application.

A prior monopole antenna Patent that purports to reduce dependence for a ground plane includes U.S. Pat. No. 3,588,903 issued to W. Hampton, on Jun. 28, 1971 which discloses the need for two or more concentric radiator tubes end fed by a coaxial cable. Power to the coaxial cable is purportedly resonant with the upper and lower frequency limits thereby shifting the current lobe away from the base, thereby attempting to maintain near zero current at the radiator base.

SUMMARY OF EXEMPLARY EMBODIMENT OF INVENTION

A monopole antenna according the principles of the present invention comprises an elongated tubular radiator having its lower end electrically connected to the center conductor of a standard coax connector. An outer metal tube having a length shorter than the length of the elongated radiator surrounds the lower end portion of the elongated radiator. An elongated center conductor extends the length and lies within the elongated radiator and is electrically connected to the lower end of the outer tube. No ground plane need be provided. In one embodiment of the present invention, the elongated radiator and the center conductor comprise parts of a coaxial cable segment.

When power at a predetermined center frequency is supplied to the elongated radiator by the coax connector, the upper, exposed portion of the elongated radiator and the outer metal tube function as radiating monopole antenna portions. Power is coupled at the predetermined frequency band from the elongated radiator to the center conductor and the outer tube. The outer tube also functions to suppress radiation of the lower portion of the elongated radiator. Accordingly, the upper portion of the elongated radiator and the surrounding metal tube contribute to the overall radiation pattern.

Many advantages and benefits are provided by the monopole antenna according to the present invention. For example, the DB vs. elevation radiation pattern is shifted in at least the forward axial direction permitting the antenna to be oriented in a directional manner, or in a selected plane, achieving optimal performance. This plane may be vertical, horizontal, or at angles therebetween, with little change in performance if optimum orientation is retained for the particular application. This pattern tailoring is independent of a ground plane and allows the antenna to be used where no ground plane is available, including on the inside of electrically transparent surfaces coverings such as composite aircraft and the like.

Although the pattern may show some loss in the 90 degree direction, the benefits far outweigh this loss for non-metallic aircraft communications in which the present antenna is oriented axially aligned with the aircraft forward axis or at some vertical angle thereto.

In addition, the monopole antenna hereof can be easily manufactured with standard parts and processes, and easily installed in a non-metallic surface coverings since no ground plane is required and it is only necessary to secure the standard coax connector and/or the antenna housing or parts.

BRIEF DESCRIPTION OF THE DRAWINGS

Other and further advantages and benefits shall become apparent with the following detailed description when taken in view of the appended drawings, in which.

DETAILED DESCRIPTION OF AN EMBODIMENT OF THE PRESENT INVENTION

Figure 1:
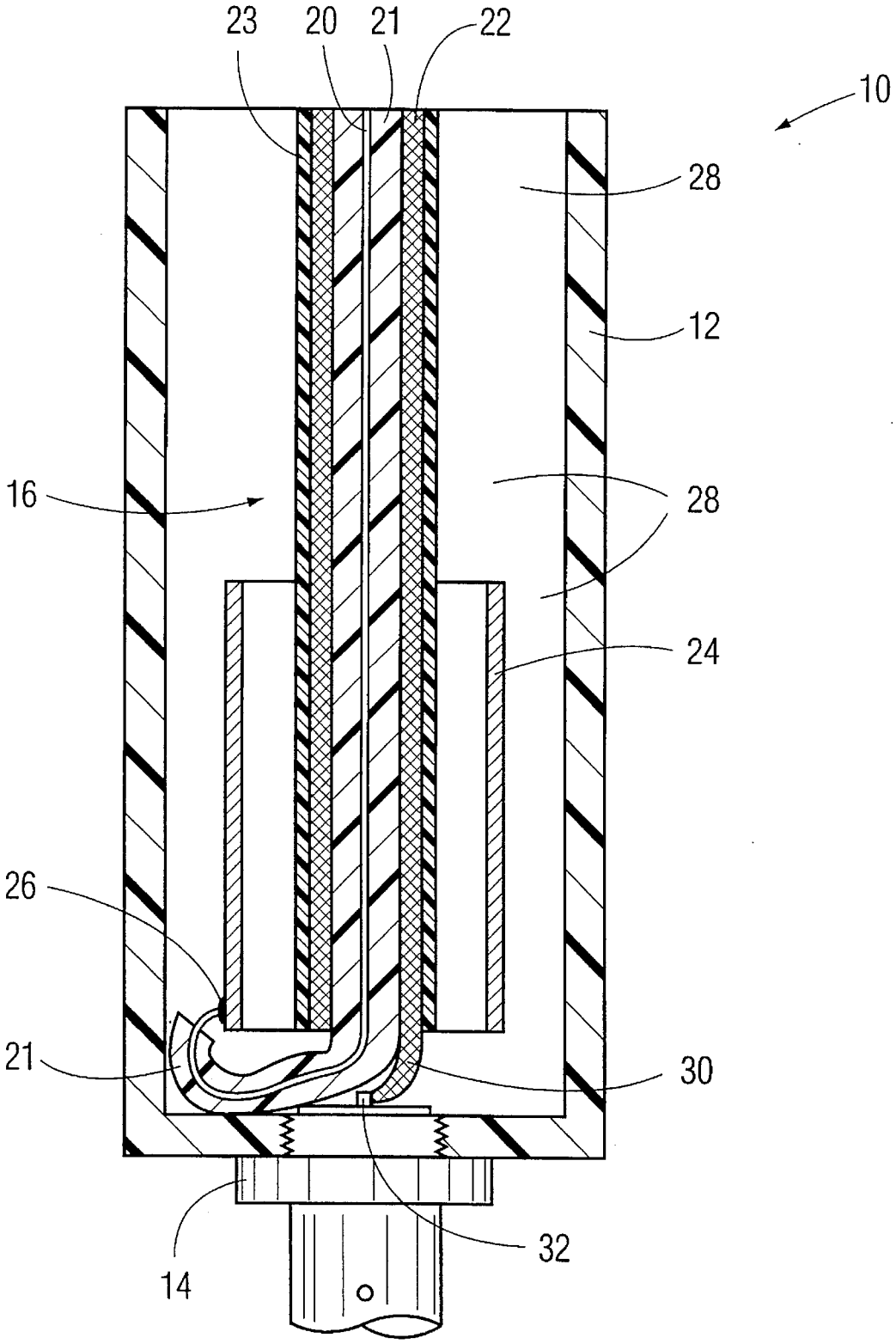
FIG. 1 is a diagrammatic vertical section of a monopole antenna in accordance with the principles of the present invention.
Figure 2:
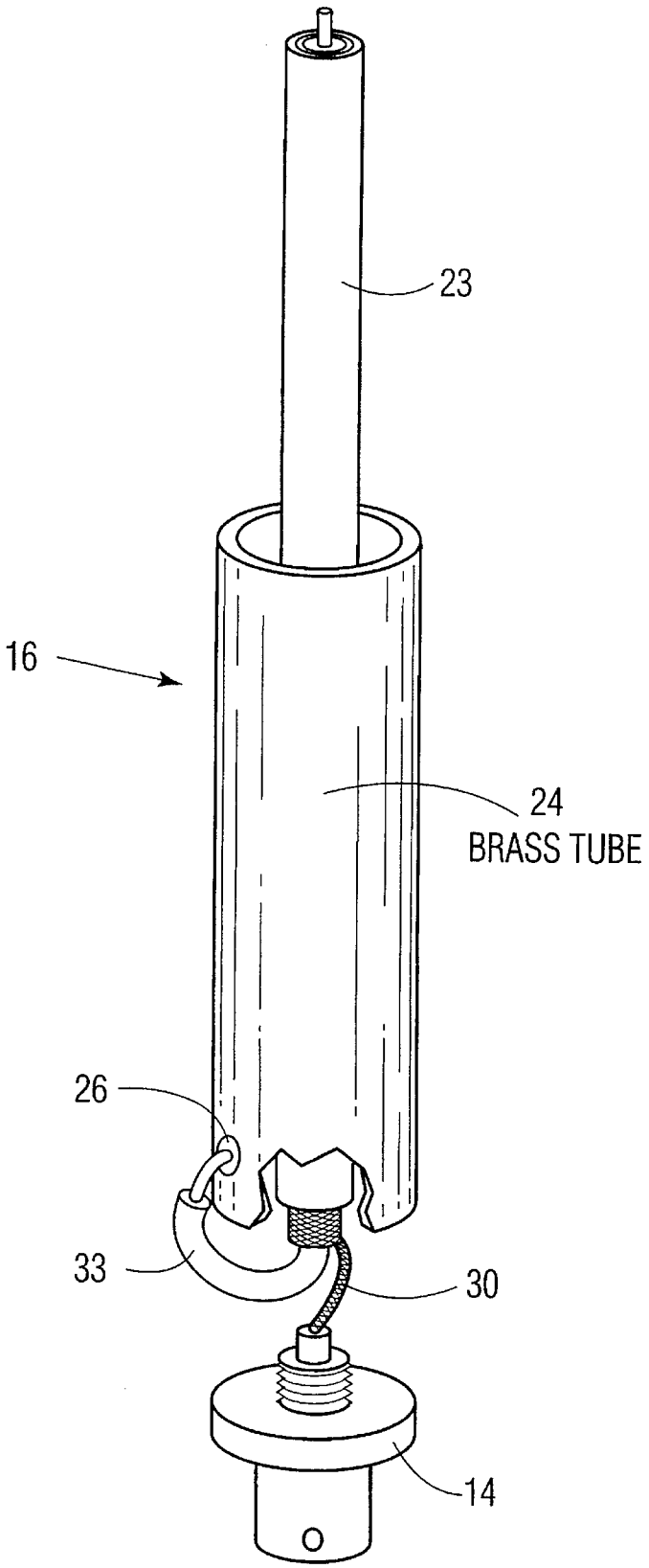
FIG. 2 is a diagrammatic perspective view of antenna parts of FIG. 1 without the housing and certain insulation shown and with certain parts broken away.

With reference to FIGS. 1 and 2, one exemplary embodiment of a monopole antenna 10 according to the principles of the present invention comprises an elongated outer dielectric housing or tube 12 having its lower end threaded to receive the threaded coupling of standard coaxial connector 14. Powered radiating and received signals can be transmitted to and from connector 14 through a coaxial cable (not shown) in the usual manner.

Antenna 10 can be mounted for operation to a dielectric part of an aircraft such as a tail, stabilizer, wing or fuselage with housing 12 oriented vertically, at an angle to the horizon or at zero elevation pointing toward the horizon in the aircraft forward direction, as further described below. Non-conductive tape, clamps, epoxy, adhesives or other suitable devices may be used to secure housing 12 on the inside of the aircraft parts (not shown) in the desired orientation.

Antenna 10 further includes a central, elongated tubular radiator 16 which, in one preferred example, comprises a coaxial cable that includes a center conductor 20, standard dielectric material 21 surrounding conductor 20, outer shield 22 about the dielectric 21 and an outer insulating material 23. Material 23 can be any suitable conventional materials such as plastic, rubber, or the like. Radiator 16 has its lower end configured with a portion of shield 22 gathered at 30 to form a short conductor that is soldered to the center conductor 32 of connector 14. Alternately, if desired, a short conductor can be connected between the bottom of shield 22 and conductor 32 instead of gathered shield portion as described. Radiator 16 center conductor 20 includes portion 33 that extends beyond the lower end of the radiator 16 along with dielectric material 21. The upper end of radiator 16 can be simply cut with no discrete electrical conductor between center conductor 20 and shield 22 at the upper end.

Antenna 10 further includes a metal member or tube 24 having its lower end of generally aligned with that of radiator 16. Tube 24 can be brass, copper, or other suitable metal. Note, however, the length of tube 24 is less than the axial dimension of radiator 16. One example includes a selection of the radiator 16 length at one quarter wave length and the length of tube 24 at one eighth wavelength at a predetermined center frequency. The free, uninsulated lower end of conductor 20 is electrically connected to the lower end of tube 24 at solder point 26.

Since the shield portion 30 is uninsulated below the base of tubes 16 and 24, it is important to secure the various parts within the tube 12 such that shield portion 30 remains spaced from tube 24. This requirement can be implemented in part by inserting the parts axially within housing 12 and filling housing 12 space 28 with foam insulation or plastic (not shown for clarity) during the manufacturing process. It is not necessary to fill the space between tube 24 and insulation 23. With parts so secured within housing 12, they will not shift during use in response to the motion of the aircraft. Housing 12 should be made of plastic or other suitable dielectric material.

Since no electrical discrete component connects center conductor 20 to center conductor 32, radiating energy and received signals transmitted through shield portion 30, which functions as an inductor or chock at high frequencies, are coupled to center conductor 20 and tube 24 through distributed capacitance and inductance. Therefore, the length of shield portion 30 (or alternately of a separate short conductor, if preferred, connected to the shield and conductor 32) should be selected so that the inductance thereof and distributed capacitance will resonate at the center frequency of the desired frequency band of antenna operation so that the greatest amount of energy is applied to radiators 16 and 24. Received signals within the selected frequency band will be coupled for transmission through connector 14 for amplification and processing. Electrical values of elements can be designed or controlled by selection of the usual parameters such as length, wall thickness and diameter of tube 24, length and gauge of radiator 16, length of shield portion 30, and the like.

For many applications, the length of radiator 16 should be selected as a harmonic length of the operating frequency, such as one-quarter or five-eighths of the wavelength at operating band center frequency. The length of radiator tube 24 approximates one-half the length of radiator 16. Thickness and type of insulation materials, dimensions of inductive/conductive/capacitive elements can be used to design desired energy coupling and distributed element values that effect bandwidth and frequency response.

In one example of a monopole antenna 10, designed for the 118–136 MHz avionics communication band, radiator 16 comprised a standard RG174 coaxial cable having a ¼ wave length at center frequency. Tube 24 was made of brass with a wall thickness of 0.015", outside diameter of 0.156", and a length of ⅛ wavelength at center frequency. Outer housing 12 was made of plastic, and a thickness of 0.075", an outer diameter of 0.4" and a length of 21 inches. Connector 14 was threaded into one end of housing 12 generally as shown in FIG. 1.

Figure 3:
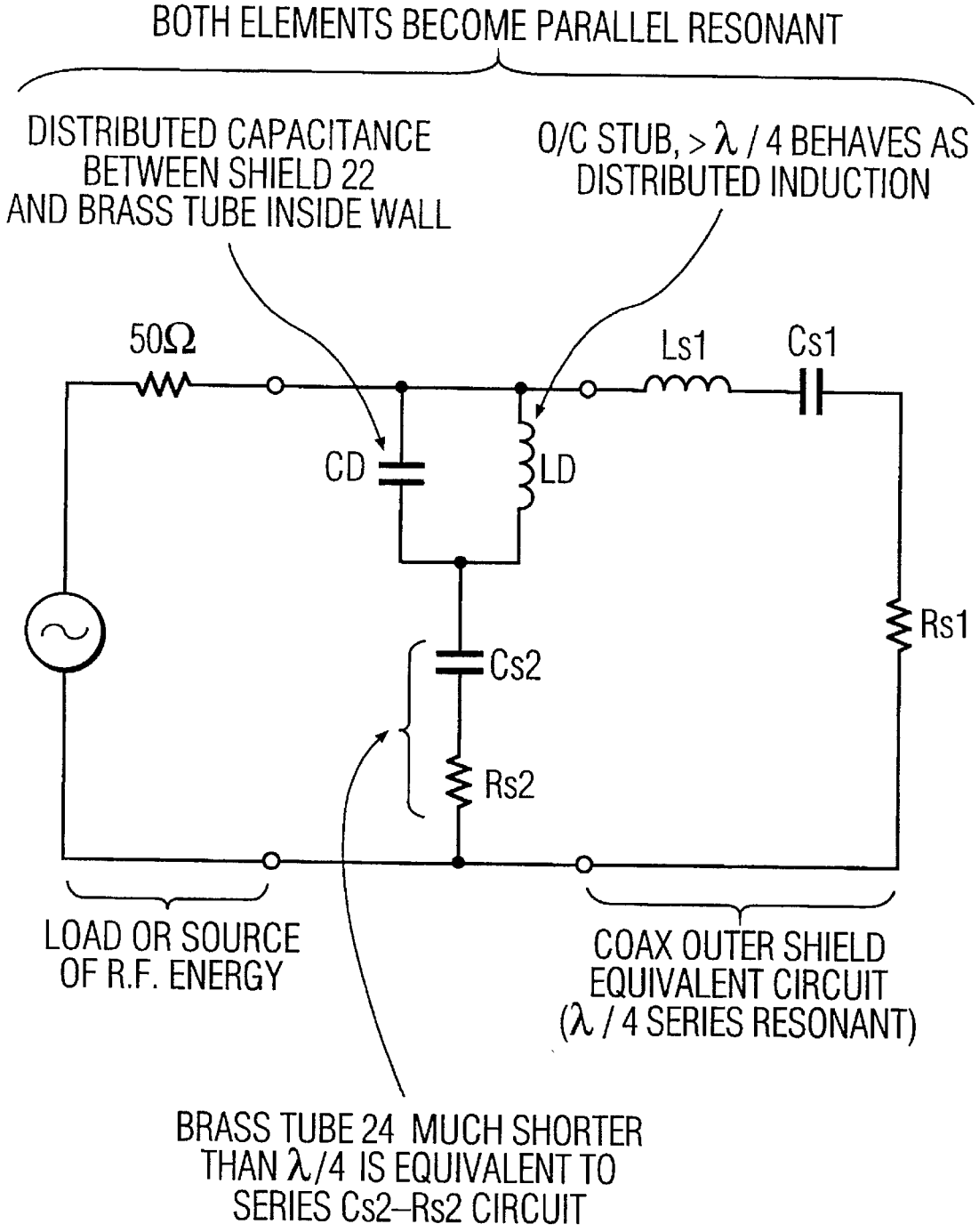
FIG. 3 is a schematic diagram an equivalent circuit of one example of antenna 10.

With reference to FIG. 3, the shield 22 behaves as a series resonant RLC equivalent circuit. Rs1 is the radiation resistance, and Ls1, Cs1 are the radiation reactance components. Employing the brass tube 24 over the coaxial cable radiator 16 generally as shown and described above, adds capacitance Cp to the circuit. With the length of Radiator 16 selected at one-quarter wavelength and tube 24 length selected at about one-eighth wavelength, tube 24 provides a non-resonant series C, R circuit denoted as Cs2 and Rs2. By connecting the center conductor 20 of coax cable radiator 16 to tube 24, Ld is introduced to the circuit in parallel with Cd. Its length is selected so that Cd and Ld form a resonant parallel circuit at the designed center frequency. The impedance provided by this resonant LC circuit increases the circuit complex impedance to improve the overall circuit VSWR and minimize the individual Cd and Ld loading effects, respectfully.

Figure 4:
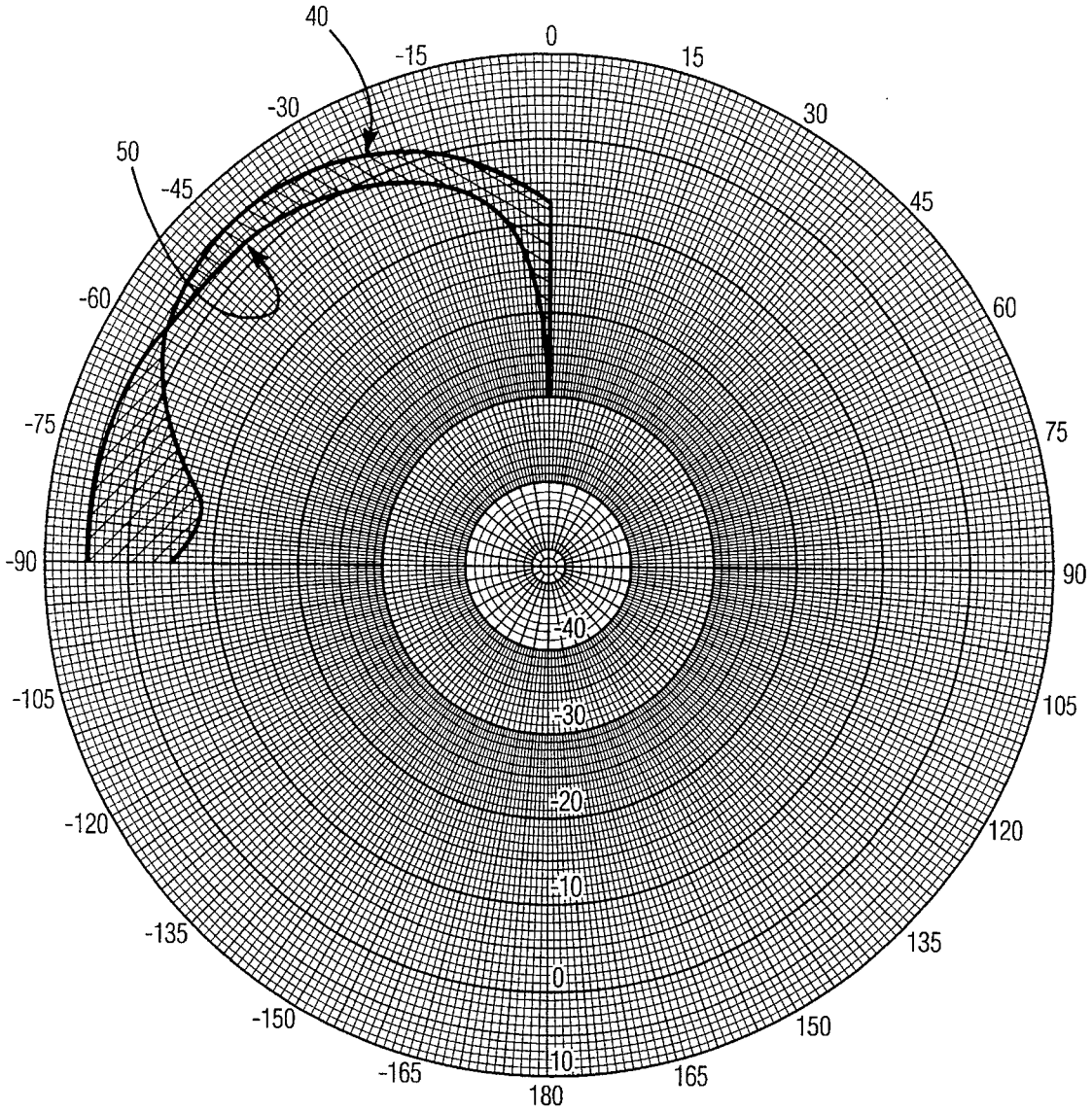
FIG. 4 is a DB vs. Elevation Radiation Pattern of a test standard monopole antenna and of the example of an embodiment of the antenna according to FIG. 3. These patterns were obtained on the same test bed and at the same center frequency for comparison of the respective radiation patterns.

With reference to FIG. 4, the radiation pattern curve of DB vs. Elevation is shown for the above mentioned example antenna using an RG-174 coax as radiator 16 without ground plane but mounted four feet above the test bed ground plane. A standard monopole antenna with ground plane was also tested at the same frequency band and center frequency. Tests were conducted at 118–136_MHZ. Zero degrees in FIG. 4 is the axial direction of the antennas tested. Both antennas were tested under the dame conditions.

It can be seen that the performance curve 40 of the monopole antenna according to the present invention provides a greater range in the general forward direction (0 to 60 degrees) compared to the radiation pattern 50 of the standard monopole antenna. Note curve 50 indicates better radiation range than curve 40 toward the side direction, i.e. from 60 to 90 degrees. However, the benefits of extending forward range, far outweigh reduction in side range for aircraft and other directed communications applications.

Although one frequency band was mentioned above, it will be understood that antenna embodying the principles of the present invention can be configured to operate in any other frequency band as well. Also, the antenna according to the present invention can be used in other applications beside aircraft, such as marine and land based mobile and stationary systems.

Further, it will be understood that although FIG. 4 shows only one quadrant, the radiation pattern actually existed through 360 degrees about the "0" reference axis of the chart.

Various modifications can be made to the exemplary embodiments disclosed herein without departing from the spirit and scope of the present invention. The drawings of parts in the figures are not drawn to scale.

For non-metallic aircraft and the like, the monopole antenna can be implemented in the form generally shown in FIG. 2 if desired, that is, without the outer housing 12 and insulation about radiator 16. Radiators 24 and 22 and connector 14 could then be simply secured to the non-metallic surface of the craft or vehicle.

Although the housing and the various parts are shown as round or cylindrical, it will be understood that other profiles or cross section shapes could be used depending upon the desired result or manufacturing design criteria. Also, the housing may be shaped in forms other than the tube shape shown herein such as a blade or other aerodynamically shaped member, and, if desired, antenna 10 can be mounted on metallic surfaces or plates. It should also be understood that the terms upper and lower as used herein refer to the relative relation of parts of antenna 10, particularly since antenna 10 can be oriented with its "0" axis pointing downward or at some angle below the horizon, if desired.

I claim:

1. A duplex monopole antenna having a predetermined center frequency of a predetermined frequency band comprising, a first elongated radiating member having a lower portion and an upper portion, a coaxial cable connector having its center conductor electrically connected to one of said upper and lower portions for applying electrical energy thereto, a second elongated radiating member surrounding said lower portion, and coupling means for coupling to said second member a portion of the electrical energy applied to said first member, said first member comprising a coaxial cable and said coaxial cable connector center conductor being electrically connected to said lower portion of said first member, and said coaxial cable comprising a shield and a conductor member being connected between the substantial bottom of said shield and the center conductor of said connector.

2. An antenna according to claim 1, wherein said coupling means comprises elements for coupling a first amount of the electrical energy when the electrical energy has a frequency at the predetermined center frequency and other amounts of electrical energy when the electrical energy has a frequency unequal to the predetermined frequency, said first amount being greater than all of said other amounts.

3. An antenna according to claim 1, wherein said first member comprises an elongated tube-like member.

4. An antenna according to claim 1, wherein said conductor member comprises a bottom portion of said shield gathered together to form a conductor.

5. An antenna according to claim 1, wherein said second member comprises a metal tube, the bottom of said first member being generally aligned with the bottom of said second member, and the length of said second member being approximately one-half of the length of said first member.

6. An antenna according to claim 5, wherein the extreme tops of the center conductor and shield of said coaxial cable freely radiate.

7. An antenna according to claim 5, wherein the length of said first member is ¼ wavelength of a predetermined frequency and the length of said second member approximates ⅛ wave length of the predetermined frequency.

8. An antenna according to claim 1, wherein said second member comprises a metal tube having a length for providing a series R-C circuit elements at a predetermined frequency, and said coupling means includes inductance means coupled to the shield of said coaxial cable having a length to provide a resonant parallel inductance value with the distributed capacitance between said shield and said second member at said predetermined frequency.

9. An antenna according to claim 8, wherein the length of said coaxial cable is ¼ wavelength of the predetermined frequency.

10. An antenna according to claim 8, wherein the resonant parallel distributed capacitive and inductive circuit is in series with the series R-L circuit of said second member at the predetermined frequency.

11. An antenna according to claim 1, further including a non-conducting housing having side wails, said connector being mounted in the bottom of said housing with its center conductor extending into the housing, and said first and second members being housed within said housing, and insulation within said housing for securing the position of at least said first member within said housing.

12. An antenna according to claim 1, wherein an insulating jacket surrounds said shield.

13. A duplex monopole antenna having a predetermined center frequency of a predetermined frequency band comprising, a first elongated radiating member having a lower portion and an upper portion, a coaxial cable connector having its center conductor electrically connected to one of said upper and lower portions for applying electrical energy thereto, a second elongated radiating member surrounding said lower portion, and coupling means for coupling to said second member a portion of the electrical energy applied to said first member, said first member comprising a coaxial cable and said coaxial cable connector center conductor being electrically connected to said lower portion of said first member, and said coaxial cable comprising a center conductor having a center conductor portion extending from the bottom of the coaxial cable and electrically connected to a surface of the second member.

14. An antenna according to claim 13, wherein said surface of the second member comprises its outer surface and said center conductor portion is connected to the substantial bottom pan of said second member.

15. An antenna according to claim 14, wherein said coaxial cable comprises a shield and a conductor member is connected between the substantial bottom of said shield and the center conductor of said connector.

* * * * *

UNITED STATES PATENT AND TRADEMARK OFFICE

CERTIFICATE OF CORRECTION

PATENT NO. : 5,621,420

DATED : April 15, 1997

INVENTOR(S) : John F. Benson

It is certified that error appears in the above-indentified patent and that said Letters Patent is hereby corrected as shown below:

Col. 6, line 21, change "wails" to "walls".
Col. 6, line 55, change "pan" to "part".

Signed and Sealed this

Fifteenth Day of July, 1997

*Attest:*

*Attesting Officer*

BRUCE LEHMAN

*Commissioner of Patents and Trademarks*